US005826646A

United States Patent [19]

Bae et al.

[11] Patent Number: 5,826,646

[45] Date of Patent: Oct. 27, 1998

[54] FLAT-TUBED HEAT EXCHANGER

[75] Inventors: Young L. Bae; Michael E. Heidenreich, both of Grenada, Miss.

[73] Assignee: Heatcraft Inc., Grenada, Miss.

[21] Appl. No.: 887,092

[22] Filed: Jul. 2, 1997

Related U.S. Application Data

[63] Continuation of Ser. No. 548,582, Oct. 26, 1995, abandoned.

[51] Int. Cl.[6] ..... F28B 1/06; F28D 1/053; F28F 3/12

[52] U.S. Cl. ..... 165/110; 165/153; 165/170; 165/177; 165/183

[58] Field of Search ..... 165/170, 153, 165/177, 178, 183, 110; 29/890.046, 890.049

[56] References Cited

U.S. PATENT DOCUMENTS

| | | | |
|---|---|---|---|
| 2,017,201 | 10/1935 | Bossart et al. | 165/177 |
| 3,662,582 | 5/1972 | French | 165/177 X |
| 3,776,018 | 12/1973 | French | 165/177 X |
| 4,516,632 | 5/1985 | Swift et al. . | |
| 4,825,941 | 5/1989 | Hoshino et al. . | |
| 4,932,469 | 6/1990 | Beatenbough | 165/170 X |
| 4,998,580 | 3/1991 | Guntly et al. . | |
| 5,054,549 | 10/1991 | Nakaguro . | |
| 5,076,354 | 12/1991 | Nishishita . | |
| 5,078,206 | 1/1992 | Goetz, Jr. | 165/153 X |
| 5,092,398 | 3/1992 | Nishishita et al. . | |
| 5,094,293 | 3/1992 | Shinmura . | |
| 5,148,862 | 9/1992 | Hashiura et al. . | |
| 5,172,758 | 12/1992 | Aoki . | |
| 5,174,373 | 12/1992 | Shinmura . | |
| 5,178,209 | 1/1993 | Aoki et al. . | |
| 5,179,845 | 1/1993 | Sasaki et al. . | |
| 5,183,103 | 2/1993 | Tokutake . | |
| 5,209,285 | 5/1993 | Joshi | 165/153 X |
| 5,279,360 | 1/1994 | Hughes et al. . | |
| 5,341,870 | 8/1994 | Hughes et al. . | |
| 5,372,188 | 12/1994 | Dudley et al. . | |
| 5,375,654 | 12/1994 | Hougland et al. | 165/177 X |
| 5,586,598 | 12/1996 | Tanaka et al. | 165/183 X |

FOREIGN PATENT DOCUMENTS

| | | | |
|---|---|---|---|
| 138079 | 4/1902 | Germany | 165/153 |
| 57-174696 | 10/1982 | Japan | 165/183 |
| 306797 | 12/1989 | Japan | 165/153 |
| 186070 | 7/1992 | Japan | 62/515 |

*Primary Examiner*—Leonard R. Leo
*Attorney, Agent, or Firm*—W. Kirk McCord

[57] ABSTRACT

A heat exchanger with an improved flat-tubed design is disclosed. The heat exchanger includes plural tubes of relatively flat cross-section in parallel array. Each tube is comprised of relatively flat first and second plates in facing contact. The first plate of each tube has a plurality of first grooves extending at a first oblique angle with respect to a major axis of the corresponding tube. The second plate of each tube has a plurality of second grooves extending at a second oblique angle with respect to the major axis of the corresponding tube, such that the first and second grooves define a cross-hatched pattern of channels to accommodate flow of heat transfer fluid through the corresponding tube. The first grooves are defined by corresponding first ridges on a first major surface of the first plate and the second grooves are defined by corresponding second ridges on a second major surface of the second plate. The first and second major surfaces are in facing relationship and each of the first ridges is in contact with at least one of the second ridges. The first grooves are located above the second grooves. When the heat transfer fluid consists of fluid in both liquid and vapor states, the heavier liquid will tend to flow through the second grooves while the lighter vapor will tend to flow through the first grooves. Because the first grooves extend in a different direction from the second grooves, separation between the liquid and vapor within the tubes is enhanced.

20 Claims, 11 Drawing Sheets

FLAT-TUBED HEAT EXCHANGER

This is a continuation of application Ser. No. 08/548,582 filed on Oct. 26, 1995, now abandoned.

FIELD OF INVENTION

This invention relates generally to heat exchangers having one or more fluid carrying tubes and in particular to a heat exchanger with an improved flat-tubed design.

BACKGROUND ART

Heat exchangers having fluid carrying tubes of relatively flat cross-section are known in the art. Such heat exchangers are often referred to as "parallel flow" heat exchangers. In such parallel flow heat exchangers, the interior of each tube is divided into a plurality of parallel flow paths of relatively small hydraulic diameter (e.g., 0.070 inch or less), which are often referred to as "microchannels", to accommodate the flow of heat transfer fluid (e.g., a vapor compression refrigerant) therethrough. Parallel flow heat exchangers may be of the "tube and fin" type in which the flat tubes are laced through a plurality of heat transfer enhancing fins or of the "serpentine fin" type in which serpentine fins are coupled between the flat tubes. Hencefore, parallel flow heat exchangers typically have been used as condensers in applications where space is at a premium, such as in automobile air conditioning systems.

Typically, the heat transfer fluid flowing in the heat exchanger tubes includes both liquid and vapor. It is advantageous in certain applications to separate the liquid from the vapor. For example, when the heat exchanger is used as a condenser in an air conditioning or refrigeration system, it is advantageous for the heat transfer fluid still in the vapor phase to be in direct contact with a greater area of the tube wall for more efficient heat transfer from the vapor inside the tube to the cooling fluid (e.g., air) outside the tube so as to completely condense the heat transfer fluid inside the tube. On the other hand, in certain other applications, it is advantageous to enhance mixing of the vapor and liquid heat transfer fluid within the tubes. For example, when the heat exchanger is used as an evaporator in an air conditioning or refrigeration system, it may be advantageous to enhance mixing between the vapor and liquid so that the liquid is in direct contact with a greater area of the tube wall for more efficient heat transfer from the fluid (e.g., air in a space to be cooled) outside the tube to the liquid inside the tube.

There is therefore a need for an improved flat-tubed heat exchanger to selectively provide enhanced separation between the heat transfer in a liquid state and the heat transfer fluid in a vapor state inside the tubes, or alternatively, enhanced mixing between the liquid and vapor inside the tubes.

SUMMARY OF THE INVENTION

In accordance with the present invention, a heat exchanger is provided having at least one elongated tube of non-circular cross-section and a support member for supporting the tube. The tube has a major axis and a minor axis and is comprised of relatively flat first and second plates in facing contact. The first plate has a plurality of first grooves in parallel array extending in a first direction at a first oblique angle with respect to the major axis. The second plate has a plurality of second grooves in parallel array extending in a second direction at a second oblique angle with respect to the major axis. The first grooves are in crossing relationship with the second grooves so that the first and second grooves define a cross-hatched pattern of channels to accommodate flow of heat transfer fluid through the tube.

In accordance with one feature of the invention, the first plate has a first major surface and the second plate has a second major surface in facing relationship with the first major surface. The first major surface has plural first ridges in parallel array extending in the first direction and the second major surface has plural second ridges in parallel array extending in the second direction. Each of the first ridges is in contact with at least one of the second ridges. Each of the first grooves is defined by two adjacent first ridges and each of the second grooves is defined by two adjacent second ridges.

In one embodiment of the invention, each of the first ridges and each of the second ridges have a generally trapezoidal cross-section. In an alternate embodiment, each of the first ridges and each of the second ridges have a generally triangular cross-section. The tube has a generally rectangular cross-section. In the preferred embodiment, the first oblique angle and the second oblique angle are each in a range from 20° to 45° relative to the major axis of the tube.

The heat transfer fluid within the tube is typically comprised of fluid in both liquid and vapor states. Because the first grooves are oriented diagonally with respect to the second grooves, the first grooves will conduct fluid in the first direction to one side of the tube, while the second grooves will conduct fluid in the second direction to an opposite side of the tube. If, for example, the first tubes are located above the second tubes (i.e., the first plate defines a top part of the tube and the second plate defines a bottom part of the tube), the lighter vapor will tend to flow through the first grooves to one side of the tube while the heavier liquid will tend to flow through the second grooves to an opposite side of the tube, thereby enhancing separation between the liquid and vapor. Separation may be further enhanced by tilting the tube so that the side on which the heavier liquid accumulates is below the side on which the lighter vapor accumulates. Conversely, if it is desired to enhance mixing between the liquid and vapor, the tube may be tilted in an opposite direction so that the side on which the heavier liquid accumulates is above the side on which the lighter vapor accumulates.

BEST MODE FOR CARRYING OUT THE INVENTION

In the description which follows, like parts are marked throughout the specification and drawings with the same respective reference numbers. The drawings are not necessarily to scale and in some instances proportions may have been exaggerated in order to more clearly depict certain features of the invention.

Figure 1:
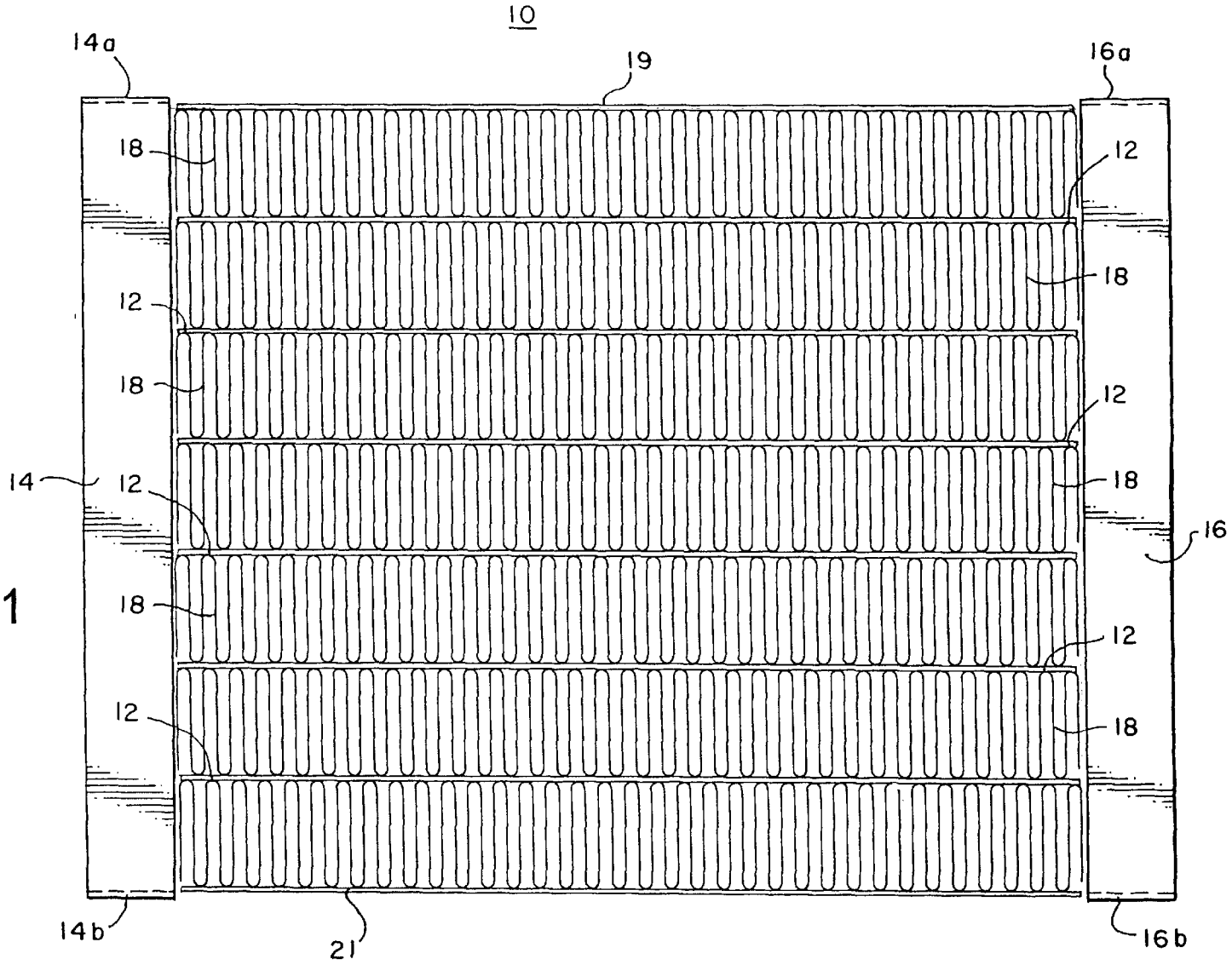
FIG. 1 is a side elevation view of an improved flat-tubed heat exchanger, according to the present invention.
Figure 2:
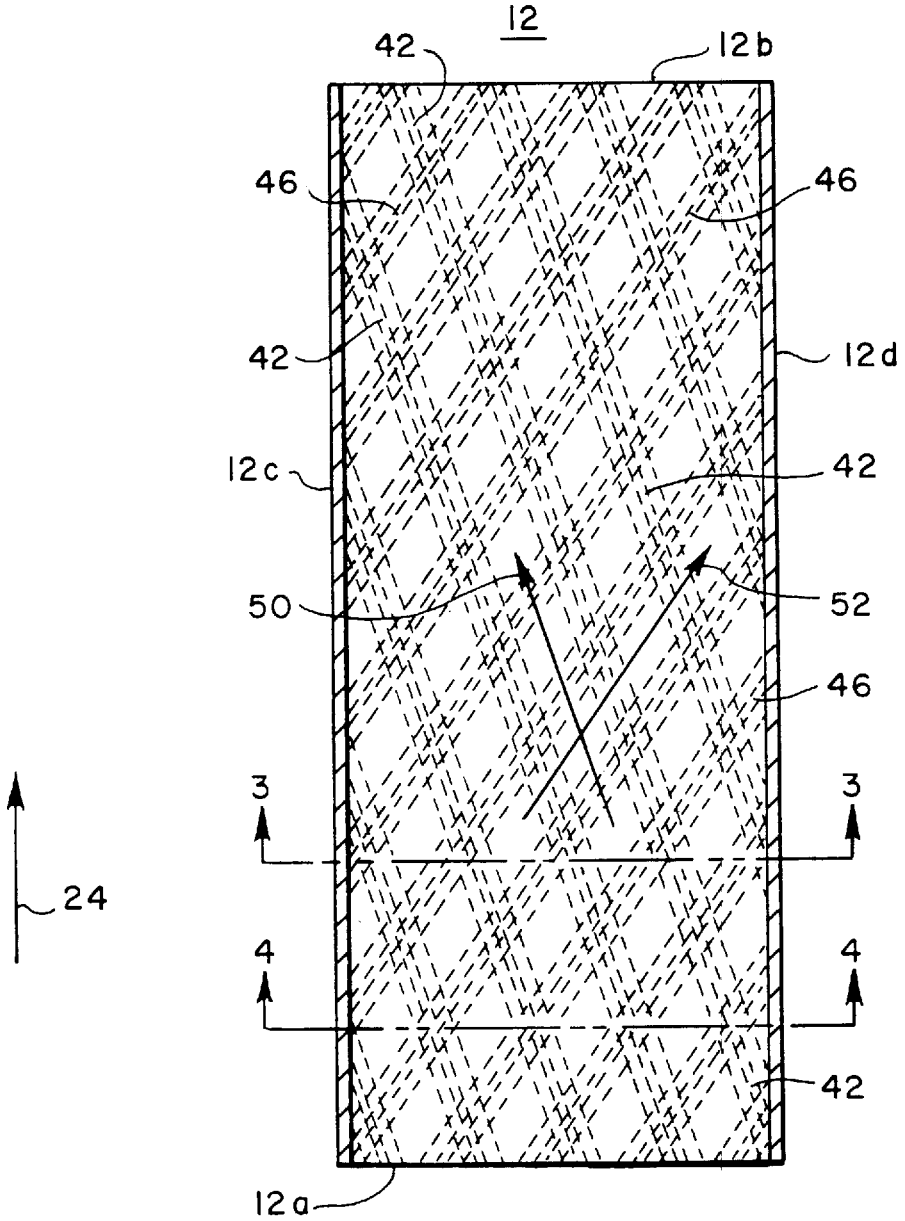
FIG. 2 is a top plan view of one of the flat tubes of the heat exchanger of FIG. 1, according to the present invention.

Referring to FIGS. 1 and 2, a heat exchanger 10, according to the present invention, is comprised of a plurality of elongated tubes 12 of non-circular cross-section extending between opposed inlet and outlet headers 14 and 16, respectively which are in an upright, vertically oriented position, as shown in FIG. 1. Tubes 12 are preferably made of metal, such as aluminum or copper. Inlet and outlet headers 14 and 16 function as support members for supporting the weight of tubes 12. Inlet header 14 has top and bottom caps 14*a* and 14*b* to close off the top and bottom of inlet header 14. Outlet header 16 has top and bottom caps 16*a* and 16*b* to close off the top and bottom of outlet header 16. A plurality of heat transfer enhancing, serpentine fins 18 extend between and are bonded, for example, by brazing, to adjacent ones of tubes 12 and are supported thereby. Fins 18 are preferably made of metal, such as aluminum or copper. Heat exchanger 10 further includes a top plate 19 and a bottom plate 21. The uppermost fins 18 are bonded to top plate 19 and to the uppermost tube 12. The lowermost fins 18 are bonded to the lowermost tube 12 and to bottom plate 21.

Each tube 12 has an inlet (not shown) at one end 12*a* thereof and an outlet (not shown) at an opposite end 12*b* thereof. The inlet of each tube 12 at end 12*a* thereof is in fluid communication with inlet header 14 and the outlet of each tube 12 at end 12*b* thereof is in fluid communication with outlet header 16, whereby heat transfer fluid (e.g., a vapor compression refrigerant) is able to flow from inlet header 14 through the inlet of each tube 12 into the corresponding tube 12 and is able to flow out of each tube 12 through the outlet of the corresponding tube 12 into outlet header 16.

Referring also to FIGS. 3–9, each tube 12 is comprised of a relatively flat first (top) plate 20 and a relatively flat second (bottom) plate 22. Each tube 12 has a major axis extending between inlet end 12*a* and outlet end 12*b* thereof, as indicated by arrow 24 in FIG. 2, and a minor axis extending transversely with respect to major axis 24 and between a left side 12*c* and a right side 12*d* of tube 12. Top plate 20 has opposed upper and lower major surfaces 26 and 28 and opposed side walls 30 and 32. Bottom plate 22 has opposed upper and lower major surfaces 34 and 36 and opposed side walls 38 and 40. Side wall 30 is joined, for example, by brazing to side wall 38 to define left side 12*c* of tube 12. Side wall 32 is joined, for example, by brazing, to side wall 40 to define right side 12*d* of the corresponding tube 12.

A first major surface (i.e., lower major surface 28) of top plate 20 is punctuated by a plurality of first ridges 42 projecting downwardly from lower major surface 28. Ridges 42 define a plurality of first grooves 44, with each groove 44 being defined by two adjacent ridges 42. Each ridge 42 has a relatively flat apex portion 42*a* and opposed side portions 42*b* and 42*c*, which are tapered inwardly from lower major surface 28 to apex portion 42*a*, to define a ridge 42 with a trapezoidal-shaped cross-section. Ridges 42 and grooves 44 extend diagonally across lower major surface 28 at a first oblique angle (i.e., preferably in a range from 20° to 45°) with respect to major axis 24.

A second major surface (i.e., upper major surface 34) of bottom plate 22 is punctuated by a plurality of second ridges 46 projecting upwardly from upper major surface 34. Ridges 46 define a plurality of second grooves 48, with each groove 48 being defined by two adjacent ridges 46. Each ridge has a relatively flat apex portion 46*a* and opposed side portions 46*b* and 46*c*, which are tapered inwardly from upper major surface 34 to apex portion 46*a*, to define a ridge 46 with a generally trapezoidal-shape. Ridges 46 and grooves 48 extend diagonally across upper major surface 34 at a second oblique angle (i.e., preferably in a range from 20° to 45°) with respect to major axis 24.

Figure 3:
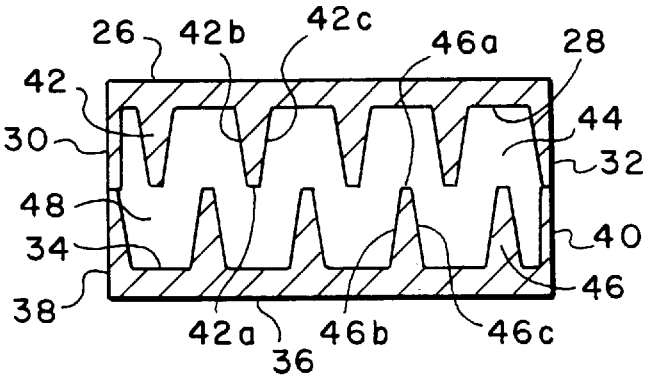
FIG. 3 is a sectional view, taken along the line 3—3 of FIG. 2.
Figure 4:
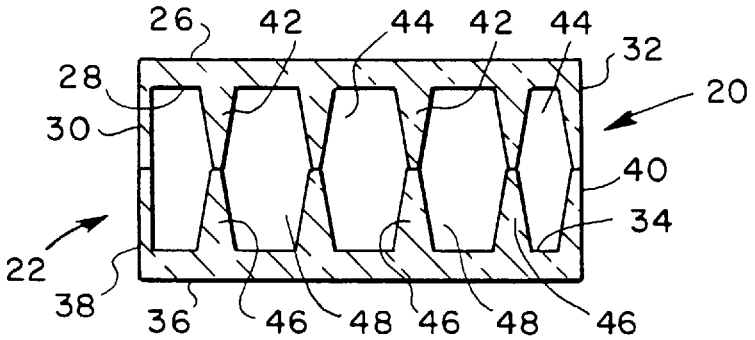
FIG. 4 is a sectional view, taken along the line 4—4 of FIG. 2.
Figure 5:
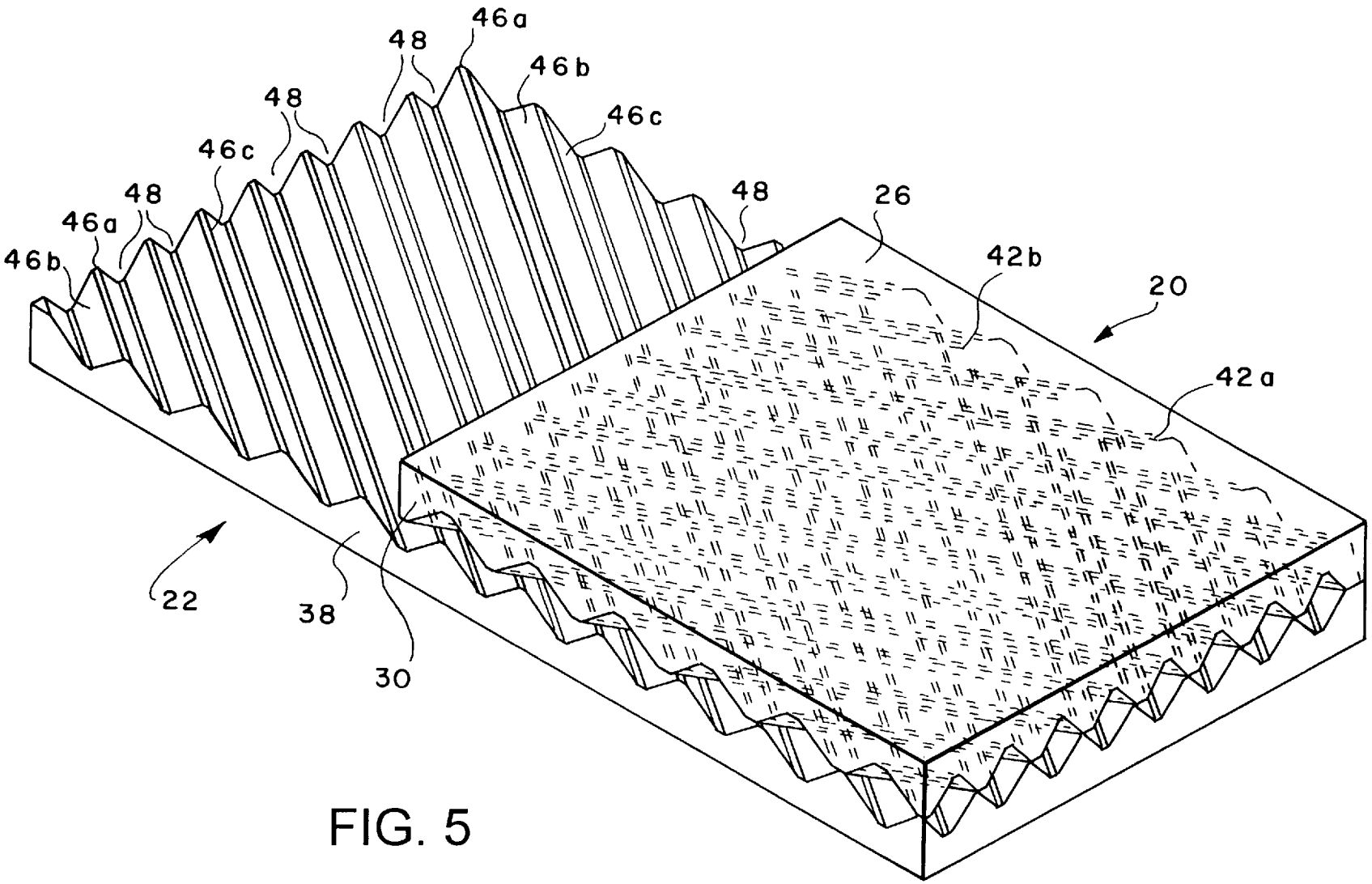
FIG. 5 is a perspective, partial cutaway view of a portion of the tube of FIG. 2.
Figure 6:
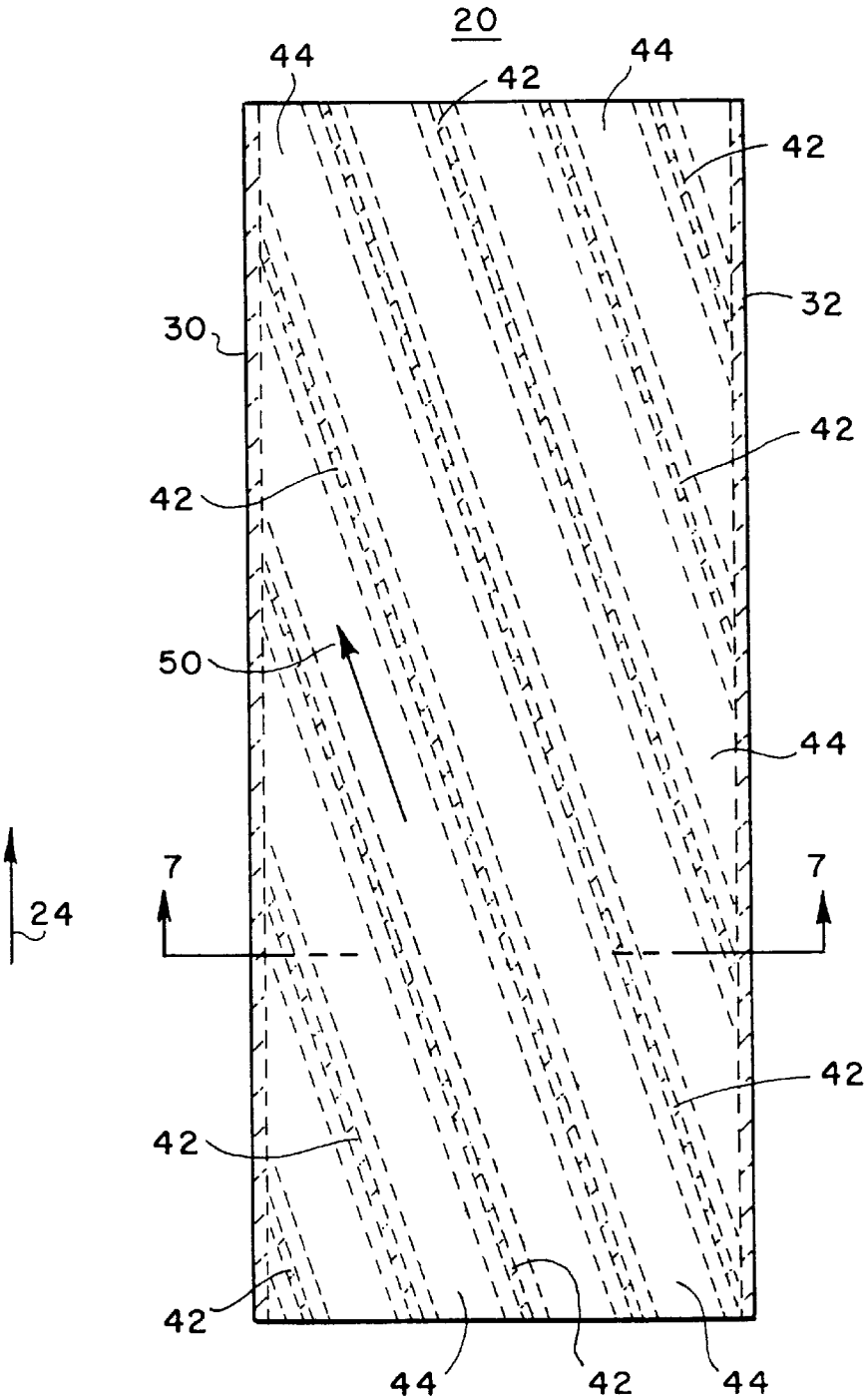
FIG. 6 is a top plan view of a top portion of the tube of FIG. 2.
Figure 7:
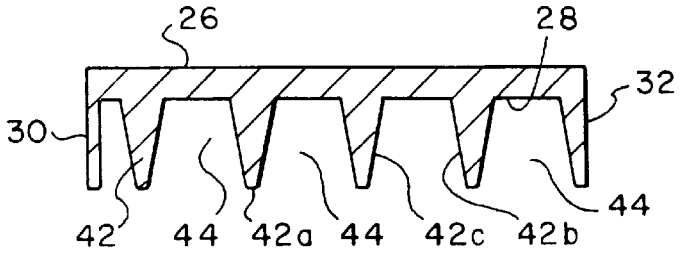
FIG. 7 is a sectional view, taken along the line 7—7 of FIG. 6.
Figure 8:
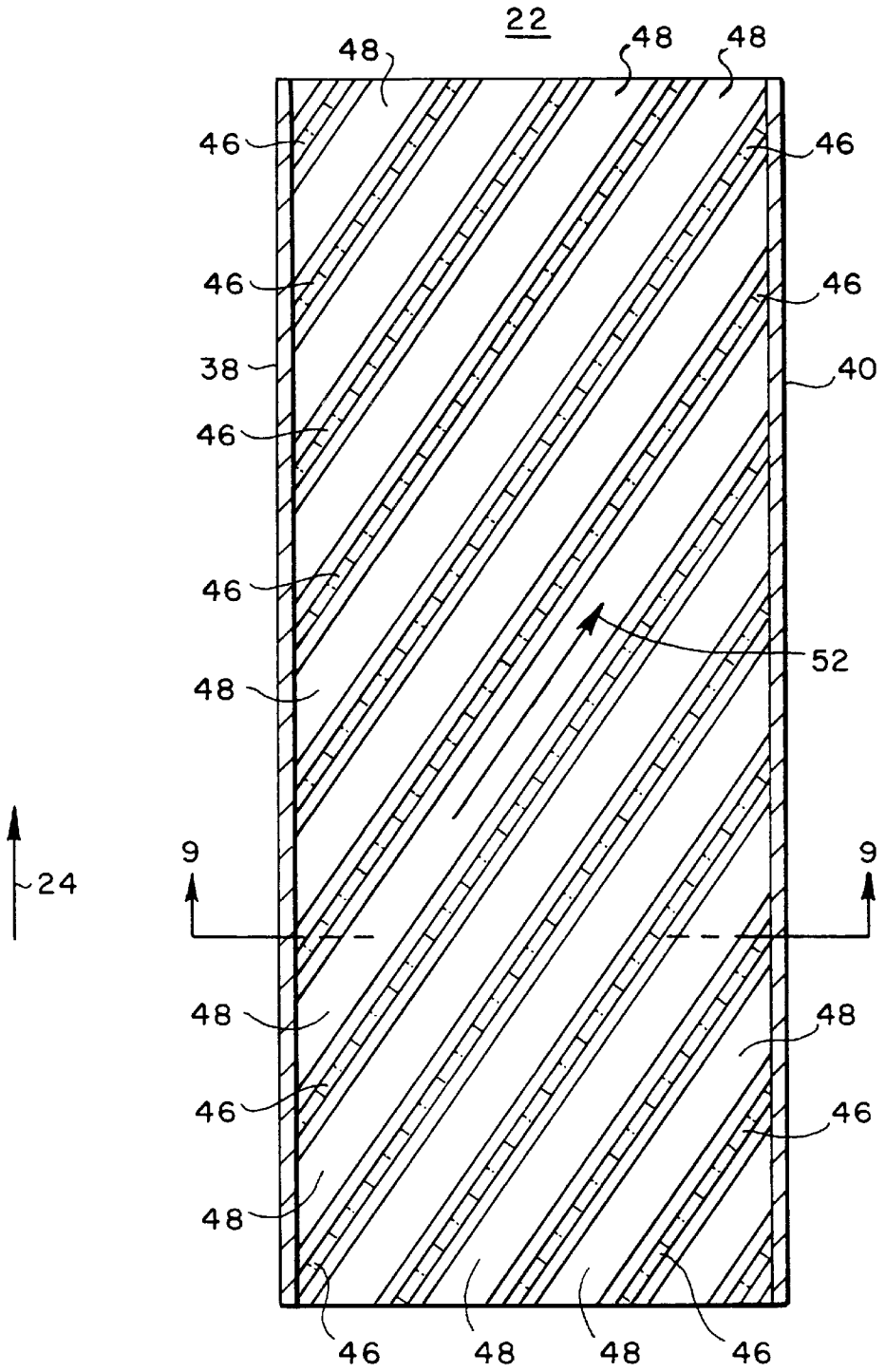
FIG. 8 is a top plan view of a bottom portion of the tube of FIG. 2.
Figure 9:
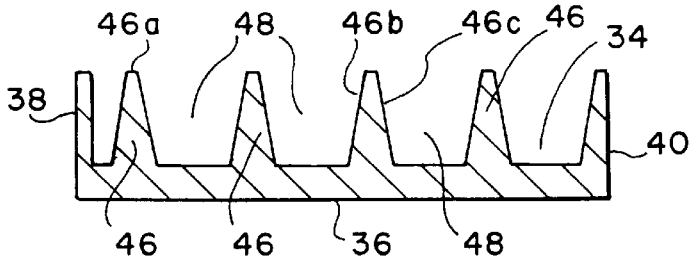
FIG. 9 is a sectional view, taken along the line 9—9 of FIG. 8.

Each tube 12 is relatively flat and has a generally rectangular cross-section with ridges 42 and grooves 44 of top plate 20 in crossing relationship with ridges 46 and grooves 48 of bottom plate 22, as can be best seen in FIG. 2. Ridges 42 and grooves 44 extend in a first direction, as indicated by arrow 50 (FIGS. 2 and 6), while ridges 46 and grooves 48 extend in a second direction, as indicated by arrow 52 (FIGS. 2 and 8). Lower major surface 28 of top plate 20 is in facing relationship with upper major surface 34 of bottom plate 22. Each ridge 42 is in contact with at least one ridge 46 (FIG. 4), where the corresponding ridge 42 crosses ridge(s) 46, but not otherwise (FIG. 3). Similarly, each ridge 46 is in contact with at least one ridge 42 where the corresponding ridge 46 crosses ridge(s) 42 (FIG. 4), but not otherwise (FIG. 3). Top and bottom plates are further joined (preferably by brazing) where apexes 42*a* and 46*a* are in contact at the crossings of ridges 42 and 46.

Grooves 44 define a plurality of first channels to accommodate the flow of heat transfer fluid and grooves 48 define a plurality of second channels to accommodate the flow of heat transfer fluid. Because grooves 44 are in crossing relationship with grooves 48, grooves 44 and 48 define a cross-hatched pattern of channels to accommodate flow of heat transfer fluid through the corresponding tube 12. Although the heat transfer fluid flows diagonally through tube 12 in the direction of arrow 50 through grooves 44 and in the direction of arrow 52 through grooves 48, the mean flow direction is generally parallel to major axis 24.

When heat exchanger 10 is used in the operation of an air conditioning or refrigeration system, heat transfer fluid, such as a vapor compression refrigerant, flows through each tube 12 between inlet and outlet headers 14 and 16. Such heat transfer fluid is typically comprised of fluid in both liquid and vapor states. Because fluid in the vapor state is lighter than the corresponding fluid in the liquid state, the vapor will tend to flow through grooves 44 in top plate 20 in a direction indicated by arrow 50 (FIG. 2), while fluid in the liquid state, being heavier than the vapor, will tend to flow through grooves 48 of bottom plate 22 in the direction indicated by arrow 52 (FIG. 2). Therefore, the vapor will tend to accumulate on left side 12*c* of tube 12, while the liquid will tend to accumulate on right side 12*d* of tube 12, thereby effecting separation between the liquid and vapor.

Figure 10A:
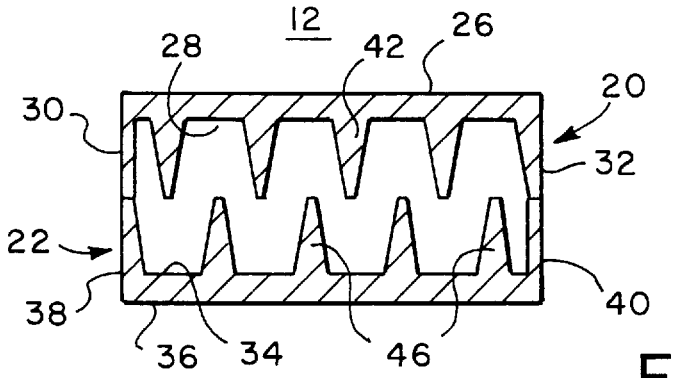
FIGS. 10A, 10B and 10C are respective sectional views, taken along the line 3—3 of FIG. 2, showing the tube oriented horizontally (FIG. 10A), rotated clockwise approximately 45° from the horizontal orientation (FIG. 10B), and rotated counterclockwise approximately 45° from the horizontal orientation (FIG. 10C)
Figure 10B:
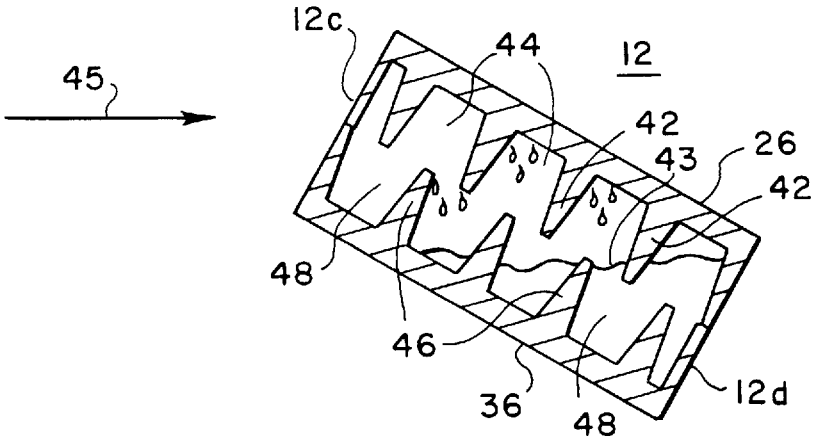
Figure 10C:
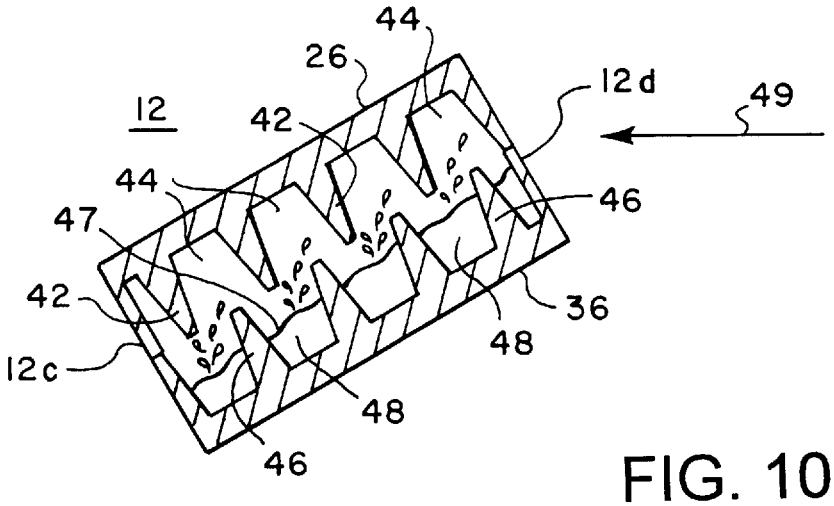

Referring also to FIGS. 10A–10C, separation may be further enhanced by tilting tube 12 in one direction (i.e., clockwise) from its horizontal orientation (FIG. 10A), as shown in FIG. 10B, so that right side 12*d* of tube 12 on which the heavier liquid accumulates is below left side 12*c* of tube 12 on which the lighter vapor accumulates. Conversely, if it is desired to enhance mixing between the liquid and vapor, tube 12 may be tilted in an opposite direction (i.e., counterclockwise) from its horizontal orientation, as shown in FIG. 10C, so that right side 12*d* of tube 12 on which the heavier liquid accumulates is above left side 12*c* of tube 12 on which the lighter vapor accumulates.

In accordance with the present invention, heat transfer is enhanced between the fluid inside tubes 12 and a fluid flowing through heat exchanger 10 on the outside of tubes 12. For example, if heat exchanger 10 is being operated as an evaporator in an air conditioning or refrigeration system, the liquid phase is the active phase of the heat transfer fluid and right side 12*d* of each tube 12 should be positioned as the leading side so that the external fluid flowing through heat exchanger 10 first encounters right side 12*d* of each tube 12, where the heavier liquid tends to accumulate.

On the other hand, if heat exchanger 10 is being used as a condenser in an air conditioning or refrigeration system, the vapor phase is the active phase of the heat transfer fluid and left side 12*c* of each tube 12 where the vapor tends to accumulate should be positioned as the leading side so that the external fluid flowing through heat exchanger 10 first encounters left side 12*c* of each tube 12.

Therefore, when heat exchanger 10 is being used as a condenser in an air conditioning or refrigeration system, the direction of flow of the external heat transfer fluid through heat exchanger 10 should be from left to right, as viewed in FIG. 2, so that the left side of each tube 12 where the vapor tends to accumulate is the leading side. Condensing of the heat transfer fluid within tubes 12 is further enhanced by tilting tubes 12 clockwise (FIG. 10B) so that the condensed fluid accumulates on the lower right side of each tube 12, thereby enhancing the area of the corresponding tube 12 over which the vapor is in direct contact with tube 12. Conversely, when heat exchanger 10 is used as an evaporator, it is advantageous to tilt tubes 12 counterclockwise FIG. 10C), to enhance mixing of the liquid and vapor. When mixing is increased, the surface area of each tube 12 in direct contact with the liquid is enhanced, thereby also enhancing heat transfer efficiency.

Figure 11:
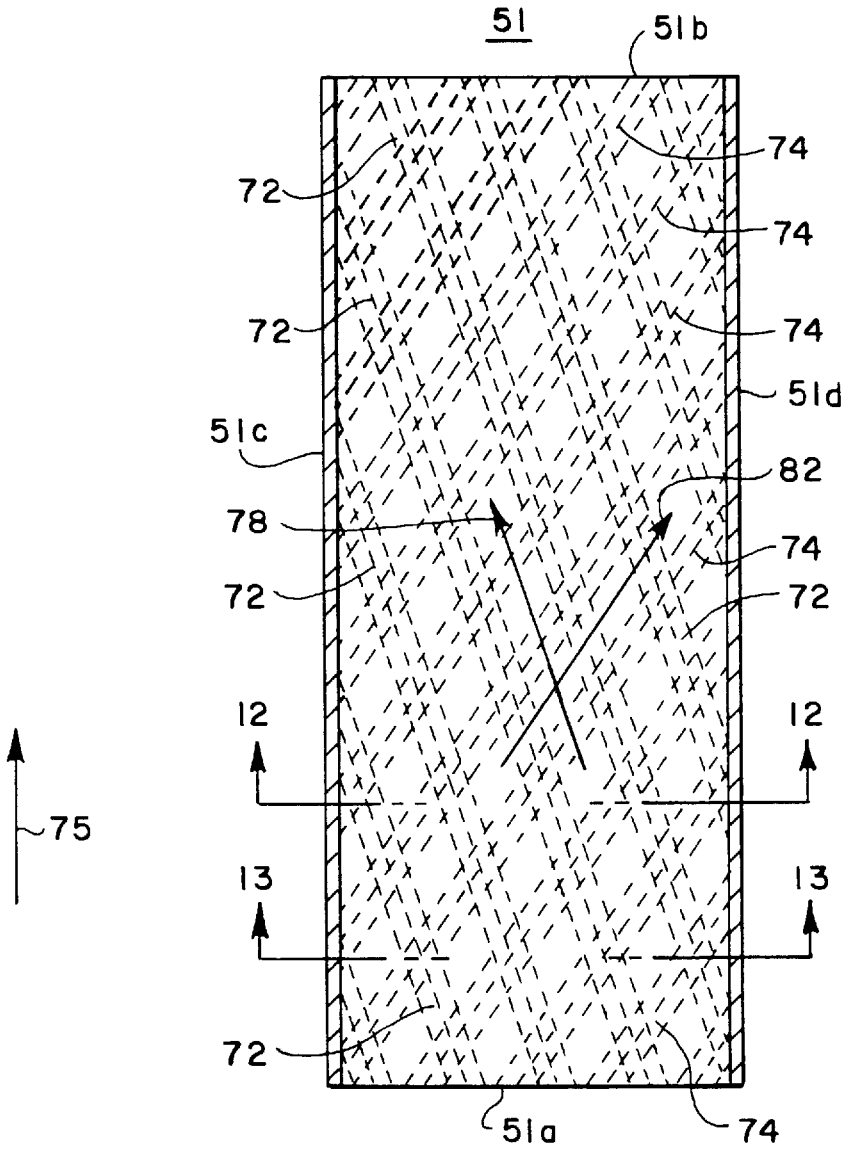
FIG. 11 is a top plan view of an alternate embodiment of a flat heat exchanger tube, according to the present invention.
Figure 12:
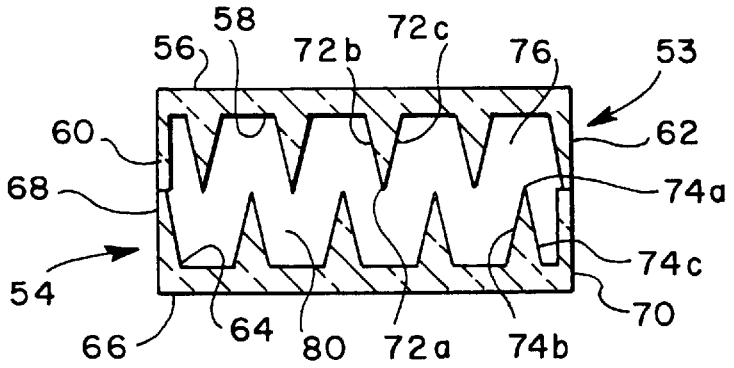
FIG. 12 is a sectional view, taken along the line 12—12 of FIG. 11.
Figure 13:
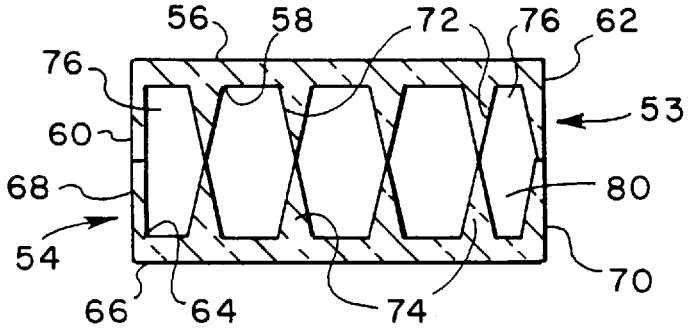
FIG. 13 is a sectional view, taken along the line 13—13 of FIG. 11.

Referring to FIGS. 11–13, an alternate embodiment of a relatively flat heat exchanger tube 51, according to the present invention, is depicted. Tube 51 is comprised of top and bottom plates 53 and 54, respectively. Top plate 53 has upper and lower major surfaces 56 and 58 and opposed side walls 60 and 62. Lower plate 54 has upper and lower major surfaces 64 and 66 and opposed side walls 68 and 70. Top plate 53 further includes a plurality of first ridges 72 projecting downwardly from lower major surface 58 and bottom plate 54 has a plurality of second ridges 74 projecting upwardly from upper major surface 64.

First ridges 72 extend diagonally across lower major surface 58 at an oblique angle (i.e., from 20° to 45°) with respect to a major axis of tube 51, which extends between an inlet end 51*a* of tube 51 and an outlet end 51*b* thereof. Arrow 75 in FIG. 11 indicates the direction of the major axis of tube 51. First ridges 72 are in parallel array and define plural grooves 76, with each groove 76 being defined by two adjacent ridges 72. Ridges 72 and grooves 76 extend along respective axes parallel to arrow 78.

Ridges 74 are in parallel array and extend diagonally across upper major surface 64 at an oblique angle (i.e., within a range from 20° to 45°) with respect to major axis 75. Ridges 74 define corresponding second grooves 80, with each groove 80 being defined by two adjacent ridges 74. Ridges 74 and grooves 80 extend along respective axes parallel to arrow 82, such that ridges 74 and grooves 80 are in crossing relationship with ridges 72 and grooves 76.

As can be best seen in FIGS. 12 and 13, lower major surface 58 is in facing relationship with upper major surface 64. Each ridge 72 is in contact with at least one ridge 74 where the corresponding ridge 72 crosses ridge(s) 74, as shown in FIG. 13. Similarly, each ridge 74 is in contact with at least one ridge 72 where the corresponding ridge 74 crosses ridge(s) 72, as can be best seen in FIG. 13. Ridges 72 are not in contact with ridges 74, except where ridges 72 and 74 cross, as can be best seen in FIG. 12.

Each ridge 72, 74 has a generally triangular cross-section. Each ridge 72 has an apex 72*a* and sides 72*b* and 72*c* tapering downwardly and inwardly from lower major surface 58 to apex 72*a*. Each ridge 74 has an apex 74*a* and sides 74*b* and 74*c* tapering upwardly and inwardly from upper major surface 64 to apex 74*a*. Side wall 60 of top plate 53 is joined (e.g., by brazing) to side wall 68 of bottom plate 54 to define a left side 51*c* of tube 51. Side wall 62 of top plate 53 is joined to side wall 70 of bottom plate 54 to define a right side 51*d* of tube 51. Ridges 72 and 74 are joined (preferably by brazing) where their respective apexes 72*a* and 74*a* are in contact. Tube 51 has substantially the same construction as tube 12, described hereinabove with reference to FIGS. 1–10C, except that ridges 72 and 74 of tube 51 have a generally triangular cross-section, as opposed to the generally trapezoidal cross-section of ridges 42 and 46 of tube 12.

In operation, heat transfer fluid flowing through tube 51 in a vapor state will tend to flow in the direction of arrow 78 through upper grooves 76 so that the vapor will tend to accumulate on left side 51*c* of tube 51. The heat transfer fluid in the liquid state will tend to flow through lower grooves 80 in the direction of arrow 82 so that the liquid will tend to accumulate on right side 51*d* of tube 51, thereby enhancing separation of the vapor from the liquid. The mean flow direction, however, is along major axis 75. As previously described with reference to FIGS. 10A–10C, separation between the vapor and liquid may be further enhanced by tilting tube 51 in one direction (i.e., clockwise as viewed in FIG. 10B) so that left side 51*c* of tube 51 is above right side 51*d* thereof. Conversely, separation between the vapor and liquid may be inhibited by tilting tube 51 in an opposite direction (i.e., counterclockwise as viewed in FIG. 10C) so that the right side 51*d* of tube 51 is above left side 51*c* thereof.

Figure 14:
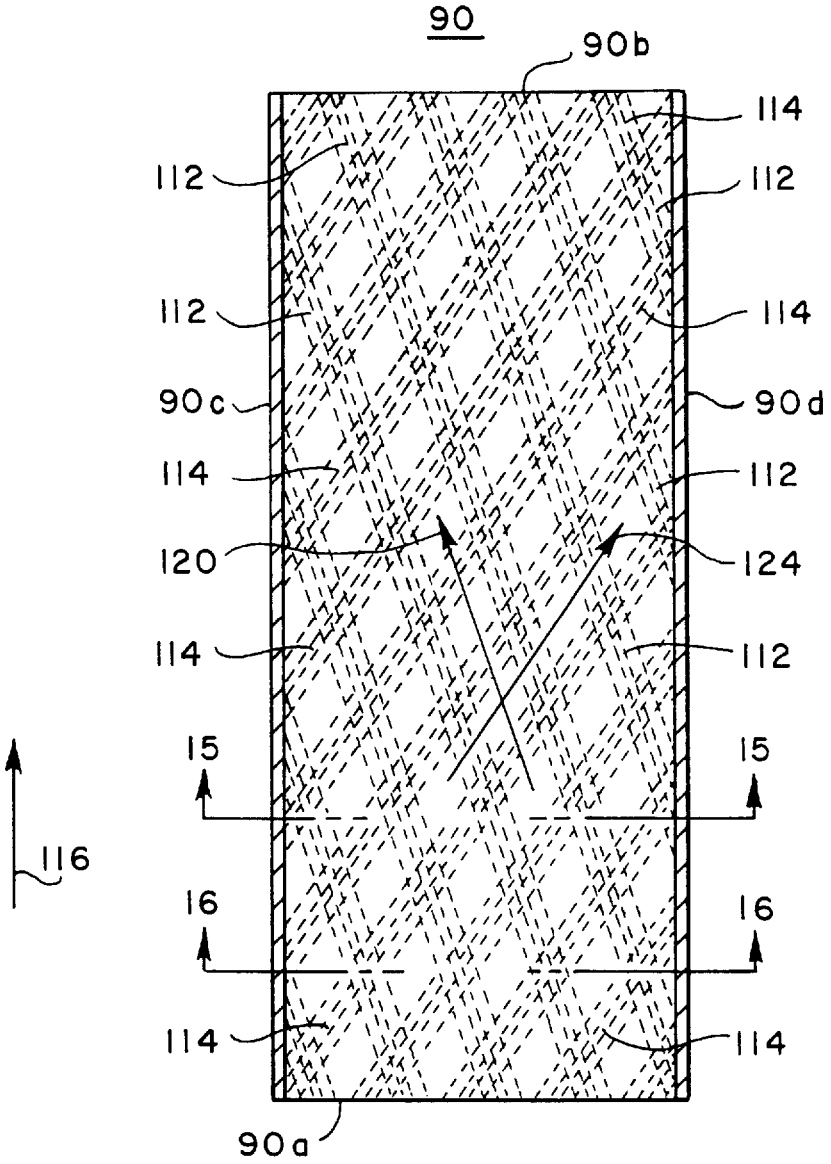
FIG. 14 is a top plan view of another alternate embodiment of a flat heat exchanger tube, according to the present invention.
Figure 15:
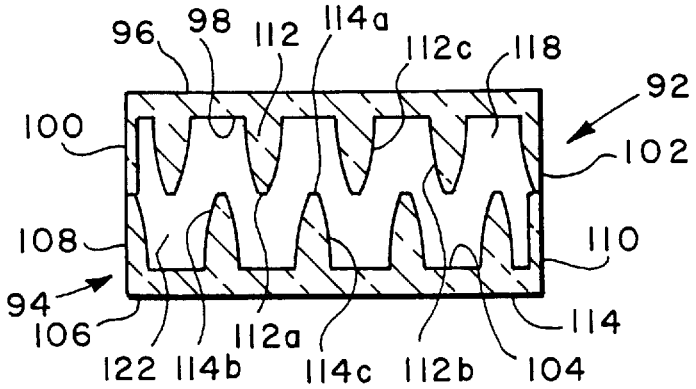
FIG. 15 is a sectional view, taken along the line 15—15 of FIG. 14.
Figure 16:
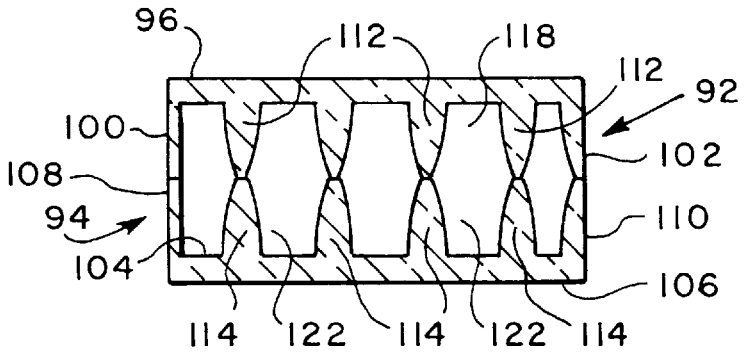
FIG. 16 is a sectional view, taken along the line 16—16 of FIG. 14.

Referring to FIGS. 14–16, another alternate embodiment of a relatively flat heat exchanger tube 90, according to the present invention, is depicted. Tube 90 is comprised of top and bottom plates 92 and 94, respectively. Top plate 92 has upper and lower major surfaces 96 and 98 and opposed side walls 100 and 102. Bottom plate 94 has upper and lower major surfaces 104 and 106 and opposed side walls 108 and 110. Top plate 92 has a plurality of first ridges 112 projecting downwardly from lower major surface 98. Each ridge 112 has an apex 112*a* and two sides 112*b* and 112*c*, which are curved and are tapered inwardly and downwardly from lower major surface 98 to apex 112*a*. Bottom plate 94 has a plurality of second ridges 114 projecting upwardly from upper major surface 104. Each ridge 114 has an apex 114*a* and two sides 114*b* and 114*c*, which are curved and are tapered upwardly and inwardly from upper major surface 104 to apex 114*a* . Each ridge 112, 114 has a generally trapezoidal cross-section with a similar configuration to ridges 42 and 46, described hereinabove with reference to FIGS. 1–10C, except that each ridge 112 has curved sides 112*b* and 112*c* and each ridge 114 has curved sides 114*b* and 114*c*, as opposed to the relatively straight sides 42*b* and 42*c* of ridges 42 and the relatively straight sides 46*b* and 46*c* of ridges 46, as shown, for example, in FIGS. 3 and 4.

Ridges 112 are in parallel array and extend diagonally across lower major surface 98 at an oblique angle with respect to a major axis of tube 90, which extends between an inlet end 90*a* of tube 90 and an outlet end 90*b* thereof. The major axis of tube 90 is indicated by arrow 116 in FIG. 14. Ridges 112 define a plurality of first grooves 118, with each groove 118 being defined by two adjacent ridges 112. Ridges 112 and grooves 118 extend diagonally across lower major surface 98 of top plate 92 in a direction parallel to arrow 120 and at an oblique angle (e.g., within a range from 20° to 45°) with respect to major axis 116. Ridges 114 define a plurality of second grooves 122, with each groove 122 being defined by two adjacent ridges 114. Ridges 114 and grooves 122 extend diagonally across upper major surface 104 at an oblique angle (in a range from 20° to 45°) with respect to major axis 116 in a direction parallel to arrow 124 such that ridges 114 and grooves 122 are in crossing relationship with ridges 112 and grooves 118.

Lower major surface 98 is in facing relationship with upper major surface 104. Ridges 112 are in contact with ridges 114 (FIG. 16) where the corresponding ridges 112 and 114 cross. Except at the crossing points, ridges 112 are not in contact with ridges 114 (FIG. 15). Top and bottom plates 92 and 94 are joined (e.g., by brazing) at side walls 100 and 108 to define a left side 90*c* of tube 90 and at side walls 102 and 110 to define a right side 90*d* of tube 90. Further, top and bottom plates 92 and 94 are joined by brazing ridges 112 and 114 together at the locations where the corresponding apexes 112*a* and 114*a* are in contact (FIG. 16).

In operation, heat transfer fluid in a vapor state within tube 90 will tend to flow through upper grooves 118 in the direction of arrow 120, while heat transfer fluid in tube 90 in a liquid state will tend to flow through lower grooves 122 in the direction indicated by arrow 124. The vapor therefore accumulates on left side 90*c* of tube 90, while the liquid accumulates on right side 90*d* thereof, thereby enhancing separation therebetween. As previously described with reference to FIGS. 10A–10C, tube 90 may be tilted in one direction (i.e., clockwise as viewed in FIG. 10B) so that the left side 90*c* of tube 90 is above right side 90*d* thereof to further enhance separation of the liquid and vapor, or in an opposite direction (i.e., counterclockwise as viewed in FIG. 10C) so that right side 90*d* of tube 90 is above left side 90*c* thereof to inhibit separation of the liquid and vapor.

Although flat tubes 12, 51 and 90 have been described hereinabove as having top and bottom plates, in an alternate embodiment (not shown), each heat exchanger tube may be comprised of only one piece of material which is folded and welded or brazed along only one side of the folded material to define a relatively flat tube. Further, although heat exchanger 10 has been described hereinabove as having heat transfer enhancing fins 18, the improved flat heat exchanger tube described herein, according to the present invention, may also be used in other types of heat exchangers, such as brazed plate heat exchangers.

In accordance with the present invention, a heat exchanger and heat exchanger tubes of non-circular cross-section are provided to enhance heat transfer efficiency by allowing enhanced separation of the liquid and vapor within the heat exchanger tubes or, alternatively, by allowing enhanced mixing between the liquid and vapor within the tubes. For example, when the heat exchanger is being used as a condenser, separating the vapor from the liquid allows the vapor to accumulate on one side of each heat exchanger tube. By positioning that side as the leading side in the direction of the flow of external cooling air through the heat exchanger, heat transfer between the external cooling air and the vapor inside the tube is enhanced. Conversely, if the heat exchanger is being used as an evaporator, it is advantageous to enhance mixing between the liquid and vapor so that the liquid is in contact with a larger area of the internal surface of the tube.

Various embodiments of the invention have now been described in detail. Since changes in and modifications to the above-described preferred embodiments may be made without departing from the nature, spirit and scope of the invention, the invention is not to be limited to said details, but only by the appended claims and their equivalents.

We claim:

1. In a cooling system, a heat exchanger for condensing a vapor compression refrigerant in said heat exchanger by transferring heat from the refrigerant to an external fluid flowing through said heat exchanger, said heat exchanger comprising:

a pair of spaced headers, one of said headers having a refrigerant inlet and one of said headers having a refrigerant outlet; and an elongated tube of non-circular cross-section extending between said headers and in fluid communication therewith at respective opposed ends of said tube, said tube having opposed top and bottom portions and opposed first and second sides, said top portion having a plurality of first grooves in parallel array extending in a first direction toward said first side and at a first oblique angle with respect to a central longitudinal axis of said tube, said bottom portion having a plurality of second grooves in parallel array extending in a second direction toward said second side and at a second oblique angle with respect to said central longitudinal axis, said first grooves being in crossing relationship with said second grooves to define a cross-hatched pattern of channels to accommodate refrigerant flow through said tube, said tube being tilted about the central longitudinal axis thereof such that said first side is higher than said second side, whereby separation between refrigerant in a vapor state and refrigerant in a liquid state is enhanced within said tube, said first side being a leading side of said tube such that the external fluid flowing through said heat exchanger first encounters said first side.

2. The heat exchanger of claim 1 wherein each of said tubes has a generally rectangular cross-section.

3. The heat exchanger of claim 1 wherein said first oblique angle and said second oblique angle are in a range from 20° to 45° with respect to said central longitudinal axis.

4. The heat exchanger of claim 1 wherein said top portion is comprised of a top plate and said bottom portion is comprised of a bottom plate, said top plate having a first major surface and said bottom plate having a second major surface in facing relationship with said first major surface, said first major surface having plural first ridges in parallel array extending in said first direction and said second major surface having plural second ridges in parallel array extending in said second direction, each of said first ridges being in contact with at least one of said second ridges, each of said first grooves being defined by two adjacent first ridges and each of said second grooves being defined by two adjacent second ridges.

5. The heat condenser of claim 4 wherein each of said first ridges and each of said second ridges have a generally trapezoidal cross-section.

6. The heat exchanger of claim 4 wherein each of said first ridges and each of said second ridges have a generally triangular cross-section.

7. The heat exchanger of claim 4 wherein said central longitudinal axis extends generally horizontally between said headers, said tube being tilted such that an axis extending perpendicularly through said first and second major surfaces is offset from a vertical axis with an acute angle therebetween.

8. In a cooling system, a heat exchanger for evaporating a vapor compression refrigerant in said heat exchanger by transferring heat to the refrigerant from an external fluid flowing through said heat exchanger, said heat exchanger comprising:

a pair of spaced headers, one of said headers having a refrigerant inlet and one of said headers having a refrigerant outlet; and an elongated tube of non-circular cross-section extending between said headers and in fluid communication therewith at respective opposed ends of said tube, said tube having opposed top and bottom portions and opposed first and second sides, said top portion having a plurality of first grooves in parallel array extending in a first direction toward said first side and at a first oblique angle with respect to a central longitudinal axis of said tube, said bottom portion having a plurality of second grooves in parallel array extending in a second direction toward said second side and at a second oblique angle with respect to said central longitudinal axis, said first grooves being in crossing relationship with said second grooves to define a cross-hatched pattern of channels to accommodate refrigerant flow through said tube, said tube being tilted about the central longitudinal axis thereof such that said second side is higher than said first side, whereby mixing between refrigerant in a vapor state and refrigerant in a liquid state is enhanced within said tube, said second side being a leading side of said tube such that the external fluid flowing through said heat exchanger first encounters said second side.

9. The heat exchanger of claim 8 wherein said tube has a generally rectangular cross-section.

10. The heat exchanger of claim 8 wherein said first oblique angle and said second oblique angle are in a range from 20° to 45° with respect to said central longitudinal axis.

11. The heat exchanger of claim 8 wherein said top portion is comprised of a top plate and said bottom portion is comprised of a bottom plate, said top plate having a first major surface and said bottom plate having a second major surface in facing relationship with said first major surface, said first major surface having plural first ridges in parallel array extending in said first direction and said second major surface having plural second ridges in parallel array extending in said second direction, each of said first ridges being in contact with at least one of said second ridges, each of said first grooves being defined by two adjacent first ridges and each of said second grooves being defined by two adjacent second ridges.

12. The heat exchanger of claim 11 wherein each of said first ridges and each of said second ridges have a generally trapezoidal cross-section.

13. The heat exchanger of claim 11 wherein each of said first ridges and each of said second ridges have a generally triangular cross-section.

14. The heat exchanger of claim 11 wherein said central longitudinal axis extends generally horizontally between said headers, said tube being tilted such that an axis extending perpendicularly through said first and second major surfaces is offset from a vertical axis with an acute angle therebetween.

15. In a cooling system, a heat exchanger for condensing a vapor compression refrigerant in said heat exchanger by transferring heat from the refrigerant to an external fluid flowing through said heat exchanger, said heat exchanger comprising:

a pair of spaced headers, one of said headers having a refrigerant inlet and one of said headers having a refrigerant outlet, each of said headers being in an upright, vertically oriented position; and an elongated tube of non-circular cross-section extending between said headers and in fluid communication therewith at respective opposed ends of said tube, said tube having opposed top and bottom portions and opposed first and second sides, said top portion having a plurality of first grooves in parallel array extending in a first direction toward said first side and at a first oblique angle with respect to central longitudinal axis of said tube, said bottom portion having a plurality of second grooves in parallel array extending in a second direction toward said second side and at a second oblique angle with respect to said central longitudinal axis, said first grooves being in crossing relationship with said second grooves to define a cross-hatched pattern of channels to accommodate refrigerant flow through said tube, said tube being tilted about the central longitudinal axis thereof such that said first side is higher than said second side, whereby separation between refrigerant in a vapor state and refrigerant in a liquid state is enhanced within said tube, said first side being a leading side of said tube such that the external fluid flowing through said heat exchanger first encounters said first side.

16. The heat exchanger of claim 15 wherein said first oblique angle and said second oblique angle are in a range from 20° to 45° with respect to said central longitudinal axis.

17. The heat exchanger of claim 15 wherein said tube is comprised of top and bottom plates, said top plate defining said top portion of said tube and said bottom plate defining said bottom portion of said tube, said top plate having a first major surface and said bottom plate having a second major surface in facing relationship with said first major surface, said first major surface having plural first ridges in parallel array extending in said first direction, said second major surface having plural second ridges in parallel array extending in said second direction, each of said ridges being in contact with at least one of said second ridges, each of said first grooves being defined by two adjacent first ridges and each of said second grooves being defined by two adjacent second ridges.

18. The heat exchanger of claim 17 wherein each of said first ridges and each of said second ridges have a generally trapezoidal cross-section.

19. The heat exchanger of claim 17 wherein each of said first ridges and each of said second ridges have a generally triangular cross-section.

20. The heat exchanger of claim 17 wherein said central longitudinal axis extends generally horizontally between said headers, said tube being tilted such that an axis extending perpendicularly through said first and second major surfaces is offset from a vertical axis with an acute angle therebetween.

* * * * *